United States Patent [19]

Creusot et al.

[11] Patent Number: 4,923,142

[45] Date of Patent: May 8, 1990

[54] GYROSCOPIC STABILIZING DEVICE FOR A PROJECTILE CONTROL INSTRUMENT

[75] Inventors: Didier Creusot, Orleans; Jean-Pierre Roux, Saint Cyr en Val, both of Fed. Rep. of Germany

[73] Assignee: Thomson-Brandt Armements, Boulogne Billancourt, France

[21] Appl. No.: 266,752

[22] Filed: Nov. 3, 1988

[30] Foreign Application Priority Data

Nov. 6, 1987 [FR] France ..... 87 15419

[51] Int. Cl.[5] ..... F42B 15/02

[52] U.S. Cl. ..... 244/3.1

[58] Field of Search ..... 244/3.1

[56] References Cited

U.S. PATENT DOCUMENTS

| | | | |
|---|---|---|---|
| 2,963,243 | 12/1960 | Rothe | 244/3.1 |
| 3,937,144 | 2/1976 | Daniels | 244/3.1 |
| 4,374,577 | 2/1983 | Brown et al. | 244/3.1 |
| 4,389,028 | 6/1983 | Kalivretenos et al. | 244/3.1 |
| 4,431,150 | 2/1984 | Epperson, Jr. | 244/3.1 |

FOREIGN PATENT DOCUMENTS

| | | |
|---|---|---|
| 2308903 | 11/1976 | France . |
| 2418922 | 9/1979 | France . |
| 2425049 | 11/1979 | France . |

OTHER PUBLICATIONS

Patent Abstracts of Japan, vol. 10, No. 132 (P-456) [2189], May 16, 1986 & JP-A-60 253 913 (Fujitsu K.K.) Dec. 14, 1985.

*Primary Examiner*—Charles T. Jordan

*Attorney, Agent, or Firm*—Pollock, VandeSande & Priddy

[57] ABSTRACT

Disclosed is a device used to bend the end of the trajectory of a rocket in the desired plane without making costly and complicated servo-control mechanisms necessary. A cardan type assembly is formed by a section of the projectile and an internal frame, a gyrostat being mounted in the internal frame. The section carries the control instrument. The device can thus be used to keep the control instrument in a stable roll position throughout the trajectory. It is thus possible to bend the trajectory in a defined direction so as to attack targets from the top with high precision. The device can be adapted to infantry rockets, aeronautical rockets and in general, to short-range projectiles.

6 Claims, 3 Drawing Sheets

GYROSCOPIC STABILIZING DEVICE FOR A PROJECTILE CONTROL INSTRUMENT

BACKGROUND OF THE INVENTION

1. Field of the Invention

The present invention concerns a gyroscopic stabilizing device used to preserve an axial reference for a projectile controlling device, designed to modify the trajectory of this projectile. It more particularly concerns a device of this type mounted in a rocket.

2. Description of the Prior Art

A rocket is fired from an aircraft or helicopter at a great distance from the target. The aircraft takes an initial point as a reference and, consequently, its position with respect to the target is well defined. This firing mode is practiced with smooth bombs. It enables the aircraft to pull out in front of the target, where it is sheltered from hostile defenses.

Usually, rockets are fired in such conditions only with sub-projectiles which have their speed reduced by parachutes at the end of their trajectory. This method has two major drawbacks. First, the precision is relatively low. Second, all kinetic energy in the rocket is lost before impact whereas this is one of the most important characteristics of the weapon.

It is also observed that a standard rocket, launched without any braking parachute, reaches the ground at a very low angle of incidence with respect to the horizontal. In normal firing conditions, relating to angle and altitude, the sensitivity in regard to the point of impact would be very poor. Consequently, the firing would be very inaccurate.

The method used to improve firing precision consists in bending the end of the trajectory of the rocket so that it reaches the target with a high angle of incidence. Hence, a lateral force is applied to the rocket, said force being obtained by means of a control instrument. This device may be a lateral booster or an aerodynamic rudder.

To bend the trajectory of the rocket in the desired plane, which is generally the vertical plane, the control instrument should be positioned in this plane.

One method would consist in using a gyroscope providing information to a servo-control unit which, in response, will position the control instrument in the right plane. The rocket would then have to carry the entire servo-control mechanism as well as an energy source to power it. A device of this type is complicated and costly and is preferably reserved for more sophisticated missiles with longer trajectories and even more precise destinations.

SUMMARY OF THE INVENTION

An object of the invention is to provide a device to preserve said control instrument in the right plane, a device which is simple and especially suited to projectiles such as rockets having relatively short trajectories and, consequently, relatively short trajectory times.

According to the invention, the gyroscopic stability is used directly. In other words, there is a rigid mechanical link between the gyroscope and the control instrument.

The device is formed by a section of the projectile, free in rotation on itself with respect to the projectile, an internal frame coupled along one of its median axes to said section, and free in rotation on said axis which is radial with respect to the section, and, mounted in said frame, a top, the rotational axis of which meets the rotational axis of said frame perpendicularly, said control instrument of the projectile being carried by said section, thus enabling it to remain in a fixed angular position with respect to a fixed reference on the ground. In short, the section and the internal frame constitute a cardan assembly.

With the top being made to rotate at high speed from the very start of the trajectory, its kinetic moment stabilizes it in its initial position. The section is related to the top, around the axis of symmetry or roll axis of the projectile by the axis of said internal frame. The section 2 is therefore stabilized in roll in its initial position, and is located in a fixed angular position with respect to a fixed reference on the ground.

Any total motion of the projectile around its axis of symmetry makes frictional moments appear at the links between the section and the front and rear parts. Preferably, said links are ball bearings in order to reduce the frictional moments as far as possible.

These frictional moments are transformed, by gyroscopic effect, into a precession of the internal frame. Its precessional drift restricts the operation of the device to a short period which, however, is sufficient for munition of this type.

Thus, the section of the projectile preserves its roll position throughout the trajectory, and the preserving of an axial reference makes it possible, at the end of the trajectory, to cause the control instrument to act in a predefined direction. Generally, said instrument will act in the vertical plane of the trajectory and, consequently, it will be in the plane defined by the roll axis of the projectile and the rotational axis of said internal frame. A target sensor could also be provided in the same plane.

BRIEF DESCRIPTION OF THE DRAWINGS

The above-mentioned features of the above-mentioned invention as well as other features, will appear more clearly from the following description of an exemplary embodiment made with reference to the appended drawings, of which.

DETAILED DESCRIPTION OF THE PREFERRED EMBODIMENTS

Figure 1:
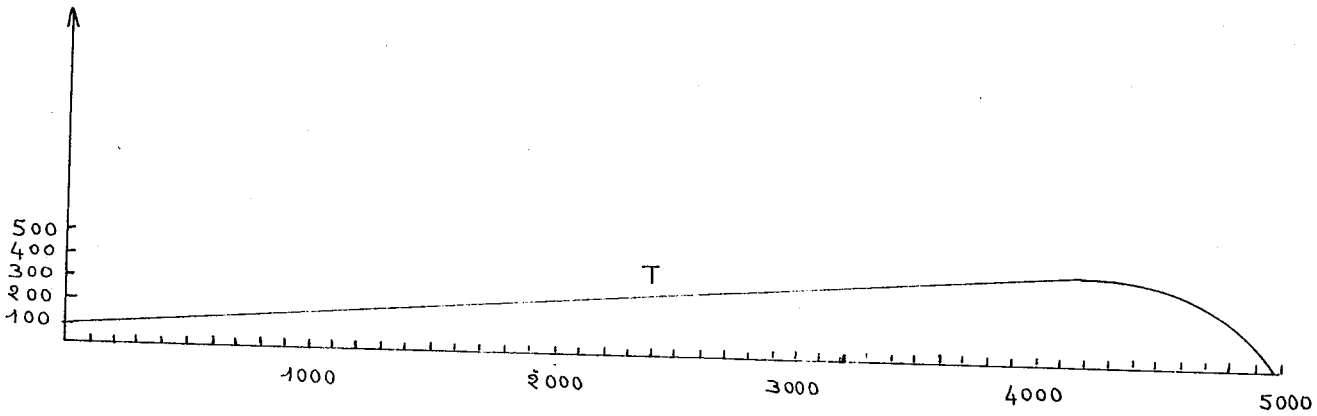
FIG. 1 is a graph showing the trajectory of a rocket provided with a device according to the invention.

The graph of FIG. 1 shows, in meters, the altitude on the Y axis and the distance on the X axis. The curve T represents the trajectory of a rocket provided with a device according to the invention launched from an airplane or a helicopter. As can be seen, the length of the trajectory is relatively short. It is 5000 m. in this case. The time interval between launching and impact is therefore very short. Furthermore, in order to be protected from hostile defenses, the aircraft opens fire at very low altitude, namely about 100 m., and the trajectory of the projectile is very flat and very slightly inclined horizontally since it ends at about 400 m., at a distance of about 4200 m. from starting point. It is therefore essential, as explained earlier, to bend the end of the trajectory towards the ground to obtain high precision.

Figure 2:
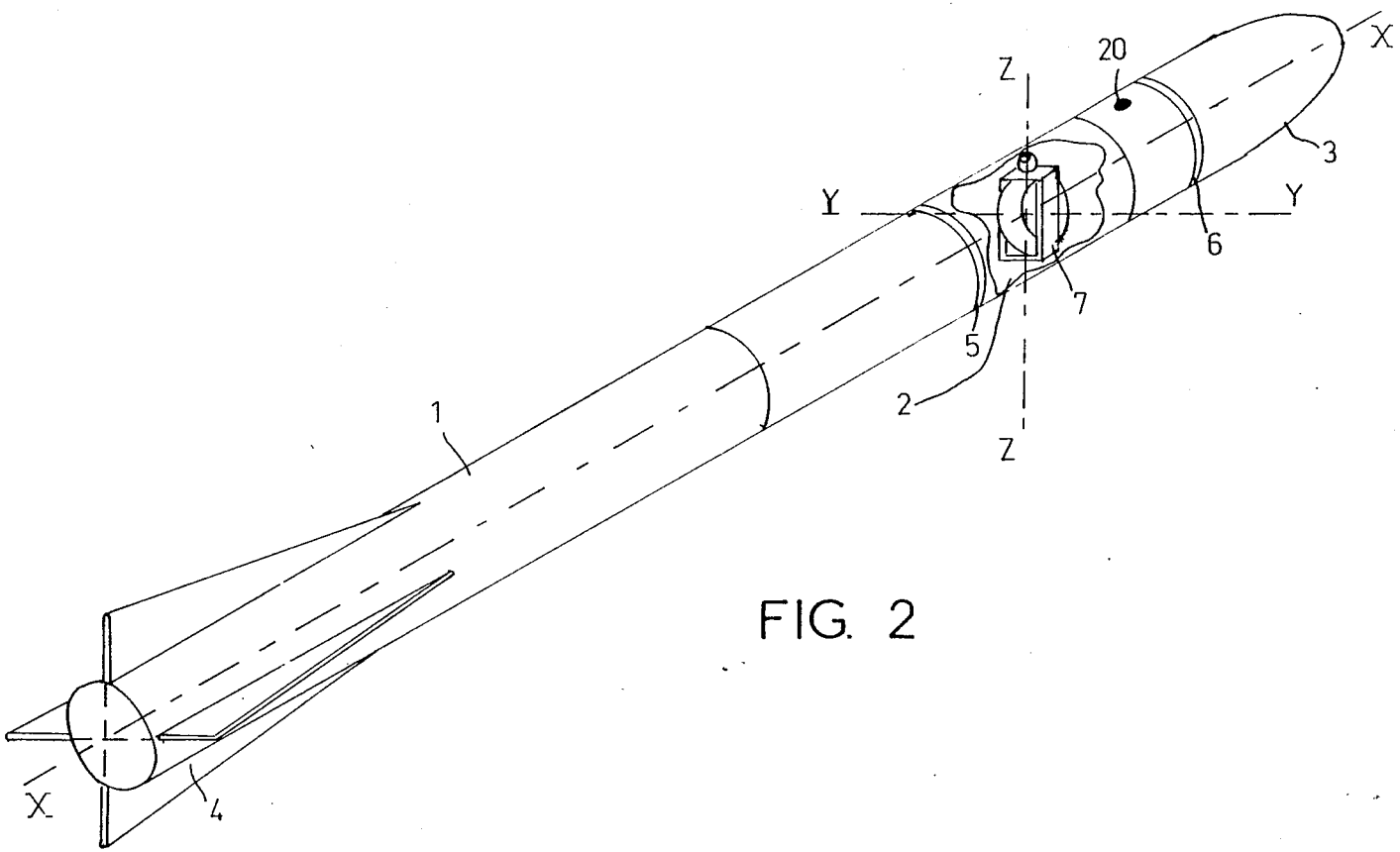
FIG. 2 is a perspective view of a rocket of this type, with a portion of its external wall cut away to reveal the device according to the invention; and, FIG. 3 is an enlarged view with partial sections of certain elements of that part of the rocket of FIG. 1 in which said device is placed.
Figure 3:
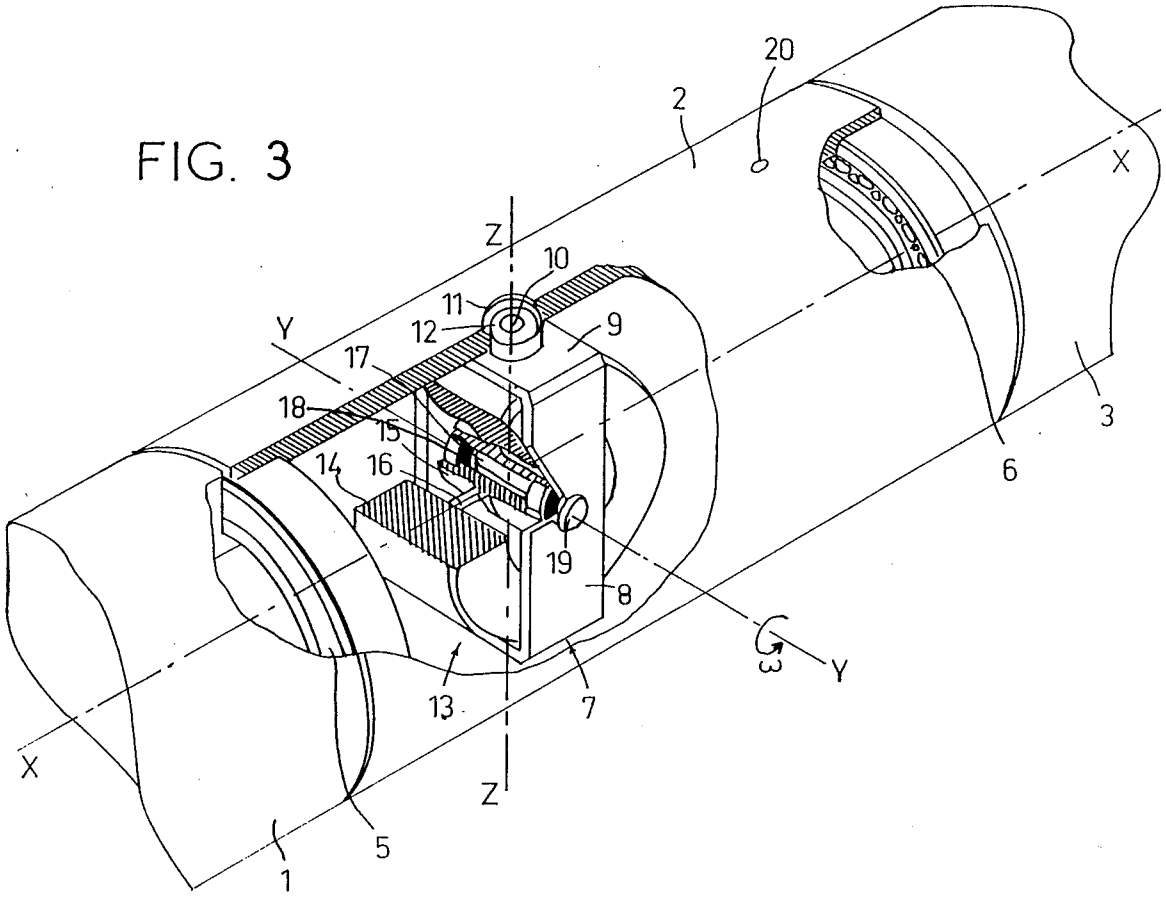

The rocket shown in FIGS. 2 and 3 has a rear part 1, a section 2 and a front part or head 3 with revolution on a longitudinal axis or roll axis X—X.

The tail of the rear part 1 has a tail assembly 4 comprising, for example, four ailerons. The rear part 1 encloses the propellant and the projectile charge itself may be placed in front of or behind the section.

The section 2 is an element of the device of the invention. Its front and rear ends are respectively connected to the head 3 and the part 1 by means of ball bearings 5 and 6 which appear clearly in FIG. 3. Thus the section 2 rotates freely on the roll axis X—X with respect to the rear part 1 and the head 3 of the projectile. The section 2 has been fixed in this manner to reduce the effect of aerodynamic forces on the projectile. For, since the aerodynamic forces are exerted preponderantly on the front part 3 of the projectile, the positioning of the section 2 on the front part of the projectile could disturb the application of the device according to the invention. However, this embodiment can be envisaged.

Inside the section 2 there is a rectangular frame 7, the uprights 8 and cross members 9 of which are end plates which give it a degree of depth. The external faces of the cross members 9 have shafts 10 at their mid-point aligned with the longitudinal median axis Z—Z of the frame 7. The shafts 10 are engaged in bearings 11 which are solidly joined with the section 2. Between the shafts 10 and the bearings 11, there are provided ball bearings 12 to reduce the frictional moments to the utmost possible extent. The axis Z—Z meets the roll axis X—X perpendicularly.

Thus, the internal frame 7 and the section 2 form an cardan assembly with one degree of freedom on the roll axis X—X and another degree of freedom on the axis Z—Z.

In the frame 7 there is mounted a gyrostat or top 13. The top 13 consists of an external ring with a rectangular section 14, connected to a cylindrical hub 15 by an intermediate ring 16 of low thickness. In the hub 15, there passes a shaft 17 carried by bearings which are at the middle of the uprights 8 of the frame 7. The hub 15 is mounted on the shaft 17 by means of ball bearings 18. The shaft 17 is aligned along Y—Y (FIG. 3), Y—Y being perpendicular to Z—Z and passing through the meeting point of Z—Z and X—X.

side of the frame 7 there is provided a means to drive the top 13 in rotation. In FIG. 3, this means is, for example, a turbine 19 which is coupled with a motor means of the carrier aircraft to convey a rotational movement to the top 13 in the direction W (FIG. 3).

Furthermore, the section 2 carries a control instrument 20. The control instrument 20 may be a booster or an aerodynamic rudder. It is in the plane defined by the roll axis X—X and the axis Z—Z. In the same plane, the section 2 could also comprise a target sensor (not shown). Generally, a standard type of proximity sensor will be chosen.

The rocket is carried by an aircraft or helicopter with the top 13 pointed along the longitudinal axis X—X of the projectile. It is held in this position by the turbine 19, coupled to the motor means of the aircraft. Consequently, the axis Y—Y is perpendicular to the axis X—X. The axis Z—Z is in the vertical plane passing through the axis X—X.

In operation, just before firing, the aircraft pulls out from the target. The top 13 is made to rotate at high speed. Its rotational axis is therefore perpendicular to the vertical plane of the trajectory which will be taken by the rocket. Thus, after launching, the top 13 is stabilized in this position and, consequently, the section 2 is also stabilized with the control instrument in the vertical plane of the trajectory. Any subsequent roll movement of the front part 1 and the head 3 will then bring out frictional moments at the ball bearings 5 and 6. These moments are converted into a precession of the internal frame 7 on the axis Z—Z. Since the interval from the launching of the rocket to its impact is very short, the precessional drift of the internal frame 7 does not become high enough to affect the working of the device, and, at the end of the trajectory, the control instrument is still correctly positioned. When it comes into operation, it therefore acts in the right plane and bends the trajectory towards the ground, in the direction of the target.

The rocket therefore reaches the ground along a high angle of incidence and with all of its kinetic energy. Its penetration capacities are high and enable its use against hard targets. Furthermore, the high angle of incidence enables an increase in the efficiency of the military charge for which the explosion is always horizontal. The same advantage is obtained by fitting proximity fuses which make the charge explode in altitude.

The preserving of a vertical reference enables the fixing of a sensor and a charge focused downwards. When the associated projectile flies over a predefined target, the sensor identifies its presence and triggers a charge thus attacking the target from the top. The prime advantage is that of attacking targets in their attitude of maximum vulnerability.

It will be noted that this principle of attacking "by the roof" is already used with missiles. The advantage of the device of the invention is that it removes the need for servo-control systems used to orient the charge downwards in the plane of the vertical. This gyrostabilized section method according to the invention can be adapted to infantry rockets, aeronautical rockets and horizontally fired projectiles in general. The focused charge may be a hollow charge, a flat charge or any other charge. Munitions of this type are especially efficient against targets such as tanks, armored vehicles and, in general, pinpoint targets with low protection on top.

What is claimed is:

1. A gyroscopic stabilizing device used to preserve a fixed angular position with respect to a reference fixed on the ground for a control instrument of a rocket-type projectile comprising:

an intermediate projectile section coupled to front and rear sections of said projectile for rotation with respect to the front and rear sections of the projectile, an internal frame coupled along one of its median axes to said intermediate section, for rotation on said one axis, and a top mounted for rotation in said frame having a rotational axis which intersects the rotational axis of said frame perpendicularly wherein a control instrument carried by said intermediate section remains in a fixed angular position.

2. A device according to claim 1, wherein the intermediate section is coupled to the front and rear sections with ball bearings.

3. A device according to claim 1 or 2 wherein the control instrument is a booster.

4. A device according to claim 1 or 2 wherein the control instrument is an aerodynamic rudder.

5. A device according to claim 1 or 2 wherein the control instrument is in the plane defined by the roll axis of the projectile and the rotation axis of the internal frame.

6. A device according to claim 1 or 2 wherein the intermediate section further has a sensor used to identify a target.

* * * * *